US005931582A

United States Patent [19]

Nichols

[11] Patent Number: 5,931,582

[45] Date of Patent: Aug. 3, 1999

[54] RECLOSABLE CLOSURE ARRANGEMENTS AND METHODS

[75] Inventor: Wendy S. Nichols, Waupaca, Wis.

[73] Assignee: Reynolds Consumer Products, Inc., Appleton, Wis.

[21] Appl. No.: 09/108,166

[22] Filed: Jun. 30, 1998

[51] Int. Cl.[6] ..... B65D 33/30

[52] U.S. Cl. ..... 383/65; 24/587

[58] Field of Search ..... 383/65, 63; 24/587, 24/399, 400

[56] References Cited

U.S. PATENT DOCUMENTS

| | | | |
|---|---|---|---|
| 2,780,261 | 2/1957 | Svec et al. | 383/65 |
| 2,823,720 | 2/1958 | Svec et al. | 383/65 |
| 3,311,144 | 3/1967 | Lindley | 383/65 |
| 3,532,571 | 10/1970 | Ausnit | 383/65 |
| 3,685,562 | 8/1972 | Ausnit | 383/63 |
| 3,959,856 | 6/1976 | Ausnit | 24/587 |
| 4,637,061 | 1/1987 | Riese . | |
| 4,812,056 | 3/1989 | Zieke | 383/65 |
| 4,858,286 | 8/1989 | Siegel . | |
| 5,369,847 | 12/1994 | Naya et al. | 383/65 |
| 5,839,831 | 11/1998 | Mazzocchi | 383/63 |

*Primary Examiner*—Stephen P. Garbe
*Attorney, Agent, or Firm*—Alan M. Biddison

[57] ABSTRACT

A flexible package includes a closure arrangement having first and second closure members. Each of the first and second closure members has a pull tab extending from a respective flange. The pull tabs are constructed and arranged to selectively disengage the first and second closure members and provide access to an interior of the flexible package. Each of the pull tabs is movable between a resting position, where the tab is lying against its respective flange, and a working position, where the tab is spaced from its respective flange. Methods for constructing and using a flexible package are provided herein.

15 Claims, 2 Drawing Sheets

30
38
44
62
50
58
32
34
52
54
48
46
36
82
78
72
70
76
74
84
80
60
68
56
66
64
42
40

RECLOSABLE CLOSURE ARRANGEMENTS AND METHODS

FIELD OF THE INVENTION

The present invention generally relates to closure arrangements for polymeric packages. In particular, the present invention relates to child-proofrecloseable closure arrangements.

BACKGROUND OF THE INVENTION

Many packaging applications use containers with zipper-type closure arrangements to store various types of articles and materials. These packages may be used to store and ship non-food consumer goods, food products, medical supplies, waste materials, and many other articles.

In certain instances, it may be desirable to store chemicals, pharmaceuticals, cleaning supplies or other toxic materials in packages with zipper closures. Concerns are sometimes raised with respect to packages containing toxic materials. In particular, it is often desirable to make such packages child-proof. That is, it is desirable to permit for adult access to the contents of the package, but preclude child access to the contents of the package. Improvements in zipper closures to preclude a child from easily opening them are desirable.

SUMMARY OF THE INVENTION

The disclosure herein describes a flexible package having a recloseable closure arrangement which is child-proof. By "child-proof", it is meant that the closure arrangement is openable to a normal adult with at least average physical and mental abilities, but is not openable to a child who lacks the physical and/or mental abilities of an average adult.

In one embodiment, a flexible package includes first and second package walls secured to one another at a bottom region and having a mouth opposite of the bottom region. A first closure member having first and second opposite ends, a first flange, a first profile extending from the first flange and a first pull tab extending from the first flange on an opposite side as the first profile is provided. The first flange is secured to the first package wall. The first pull tab is cantilevered from the first flange. The first pull tab has a first free end and a first base portion integral with the first flange. The first free end is between the bottom region of the package and the first base portion. A second closure member is provided which has opposite third and fourth ends, a second flange, a second profile extending from the second flange, and a second pull tab extending from the second flange on an opposite side from the second profile. The second flange is secured to the second package wall. The second pull tab is cantilevered from the second flange. The second pull tab has a second free end and a second base portion integral with the second flange. The second free end is between the bottom region and the second base portion. The first and second pull tabs are constructed and arranged to selectively disengage the first and second profiles and open the mouth.

Preferably, each of the first and second pull tabs is movable between a resting position and a working position. The resting position includes each of the free ends of the pull tabs lying against its respective flange. The working position includes each of the respective free ends of the first and second pull tabs being spaced from its respective flange.

In another aspect, the disclosure herein describes a method of constructing a flexible package. The method includes steps of providing a first film wall having a top edge, and providing a second film wall having a top edge. A first closure member is provided having opposite first and second ends, a first flange, a first profile extending from the first flange, and a first pull tab extending from the first flange on an opposite side from the first profile. The first flange is secured to the first film wall top edge at the first closure member first end to orient a first free end of the first flange toward the first film wall. The second end of the first flange extends freely from the first film wall. A second closure member is provided having opposite third and fourth ends, a second flange, a second profile extending from the second flange, and a second pull tab extending from the second flange on an opposite side from the second profile. The second flange is secured to the second film wall top edge at the second enclosure member third end to orient a second free end of the second flange toward the second film wall. The second profile is oriented to oppose the first profile to allow for selective engagement.

In other aspects, the disclosure herein describes a method for using a flexible package. The method comprises steps of providing a flexible package having an interior, a product-supporting bottom, a mouth providing access to the interior, and a closure arrangement. The closure arrangement includes a first closure member secured to a first wall of the flexible package, and a second closure member secured to an opposite, second wall of the flexible package. The first closure member has a first interlocking profile and a first pull tab on a side opposite of the first interlocking profile. The first pull tab has a first free end oriented toward the product-supporting bottom and lying against the first closure member. The second closure member has a second interlocking profile engaged with the first interlocking profile, and a second pull tab on a side opposite of the second interlocking profile. The second pull tab has a second free end oriented toward the product-supporting bottom and lying against the second closure member. The first and second free ends of the respective first and second pull tabs are lifted away from the respective first and second closure members. The first and second pull tabs are pulled to disengage the first and second interlocking profiles and to open the mouth.

Some methods for using a flexible package described herein preferably used constructions as described herein.

The above summary of the invention is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the detailed description of various embodiments of the invention that follows in connection with the accompanying drawings in which.

Figure 1:
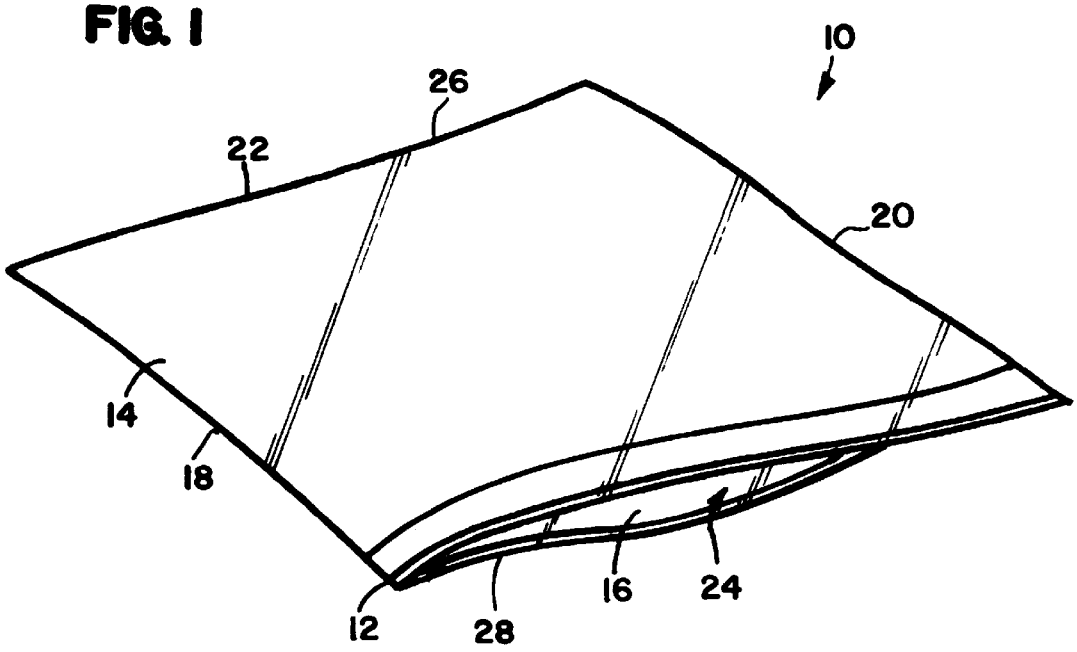
FIG. 1 is a schematic perspective view of a flexible package according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENT

The present invention is believed to be applicable to a variety of packaging arrangements. The invention has been found to be particularly advantageous for use in sealing mechanisms for polymeric packages. An appreciation of various aspects of the invention is best gained through a discussion of an application example for such a packaging arrangement.

According to an example embodiment of the present invention, a package includes a closure arrangement to allow for manual closure and sealing of a package, while providing a way for precluding a child to re-open the package after closure. FIG. 1 illustrates an example type of package 10 that benefits from use of such a closure arrangement.

FIG. 1 illustrates an example packaging arrangement in the form of a flexible package 10 having a closure mechanism 12 constructed in accordance with the present invention. The flexible package 10 includes first and second opposed panel sections 14, 16 made from a flexible, polymeric film. For some manufacturing applications, the first and second panel sections 14, 16 are heat-sealed together along two edges 18, 20 and meet at a fold line 22 in order to form a 3-edged containment section for a product within an interior 24 of the package 10. The fold line 22 comprises a product-supporting bottom or bottom edge 26, depending on the orientation which the package 10 is held. Alternatively, two separate panel sections 14, 16 of polymeric film may be used and heat-sealed together along two opposite edges 18, 20 and along edge 26. Access is provided to the interior 24 of the package 10 through a mouth 28.

Package 10 includes a product side and a consumer side. As used herein, the term "product side" refers to the volume inside of the package 10 between the closure mechanism 12 and the edges 18, 20, and 26. The "consumer side" refers to a side opposite of the product side, and is the region of the package 10 accessible by the user when the closure mechanism 12 is in a closed or sealed orientation.

The flexible package 10 may be used to hold a variety of products. Such products may include groceries, edible food products, clothing, cleaning supplies, pharmaceuticals, and toxic substances.

Closure mechanism 12 is illustrated in FIG. 1 at the mouth 28 of the flexible package 10. Each closure mechanism 12 extends the width of the package 10. In one particular embodiment illustrated in FIGS. 2 and 3, the closure mechanism 12 of FIG. 1 is shown in the specific form of a zipper-type mechanism 30. By the term "zipper-type mechanism", it is meant a structure having oppositely disposed interlocking or mating profiles, which under the application of pressure, will interlock and block access between the profiles.

Figure 2:
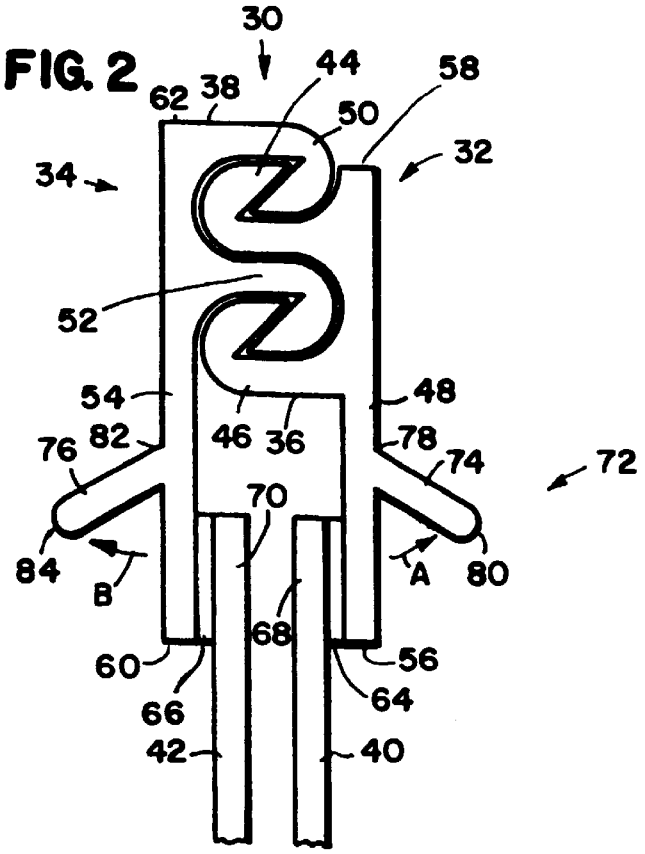
FIG. 2 is a fragmented, cross-sectional, schematic view of a closure mechanism, with pull tabs in an extended, working position, according to an example embodiment of the present invention.
Figure 3:
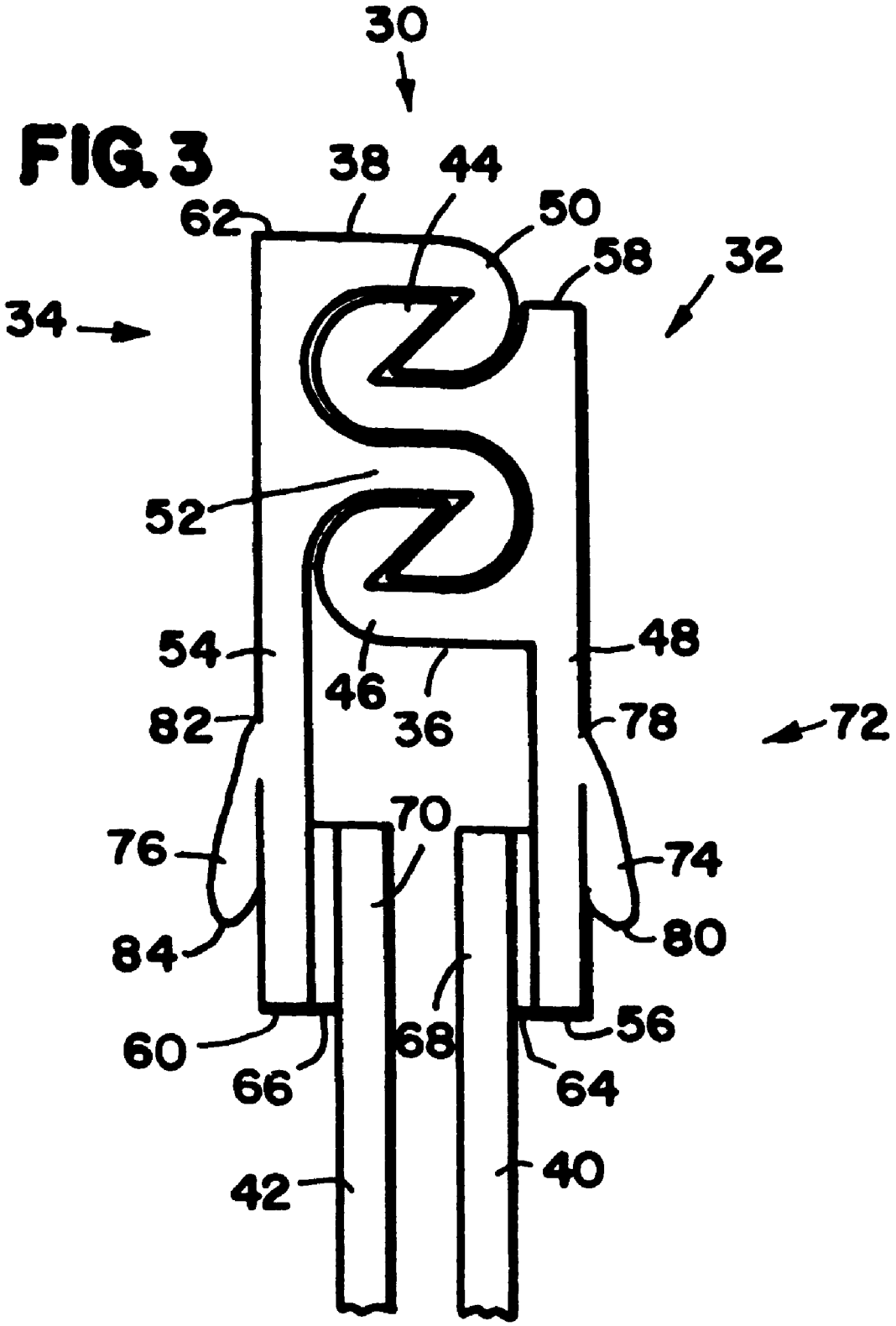
FIG. 3 is a fragmented, cross-sectional, schematic view of the closure mechanism illustrated in FIG. 2 and depicting the pull tabs in a resting position, according to an example embodiment of the present invention.

Attention is directed to FIGS. 2 and 3. In FIGS. 2 and 3, closure mechanism 30 is illustrated as having a first closure member 32 and an oppositely disposed second closure member 34. First closure member 32 includes a first closure profile 36, and second closure member 34 includes a second closure profile 38. Each of first closure member 32 and second closure member 34 is secured to a respective wall section 40, 42 of a flexible package. For example, wall section 40 may correspond to first panel section 14 (FIG. 1), while wall section 42 corresponds to second panel section 16 (FIG. 1).

Closure mechanism 30 illustrates a dual-track zipper. By "dual-track zipper", it is meant the first and second closure members 32, 34 have two tracks, typically one immediately adjacent to the next, which interlock with oppositely disposed profile members. For example, in FIG. 2, first closure member 32 comprises first profile 36 with first and second members 44, 46 in extension from a base flange 48. The second closure member 34 comprises second closure profile 38 having a first member 50 for engaging and interlocking with first member 44, and a second member 52 for engaging and interlocking with second member 46. Members 50, 52 extend from a base flange 54. The combination of member 44 and member 50 forms the first track of the dual-track zipper arrangement. Analogously, the combination of member 46 and member 52 forms the second track of the dual-track closure mechanism 30.

FIGS. 2 and 3 illustrate the closure mechanism 30 in a locked or sealed orientation. That is, first and second profiles 36, 38 are mated and interlocked with each other to prohibit access between first profile 36 and second profile 38. Arranged in a flexible package such as that illustrated at 10 in FIG. 1, the locked or sealed orientation of FIGS. 2 and 3 will prevent access to package interior 24.

The first closure member 32 has a first end 56 and an opposite, second end 58. The first end 56 corresponds and is defined by the end of flange 48. The second end 58 terminates with the end of the first profile 36. As can be seen in FIG. 2, flange 48 extends no further than the second end 58. Stated another way, first closure member 32 lacks flanges on the consumer side of the package.

Analogously, second closure member 34 has a first end 60 and an opposite second end 62. The flange 34 has an end which defines first end 60. The second end 62 is defined by the second profile 38. The flange 54 extends no further than the second end 62. That is, the second closure member 34 lacks a flange on the consumer side of the package.

Still in reference to FIG. 2, the closure mechanism 30 terminates with the first and second profiles 36, 38. The first closure member 32 is secured to the first wall section 40 at flange 48. In the specific embodiment shown in the drawing, the flange 48 is secured to wall section 40 such that first end 56 is secured to the package wall 40, but second end 58 is cantilevered from and freely extending from wall section 40. Similarly, second closure member 34 is secured to wall section 42 such that end 60 is secured to the wall 42, but end 62 is cantilevered from and freely extending from wall 42.

A sealant layer 64, 66 may be used to secure the first and second closure members 32, 34 to their wall sections 40, 42, respectively. Conventional techniques such as heat sealing may be used to create the bond. Preferably, the bond strength between each respective flange 48, 54 and wall section 40, 42 is greater than the bond strength between the interlocking closure profiles 36, 38. Typically, the bond strength between the flanges 48, 54 and wall sections 40, 42, respectively, is about 50 to 100 percent greater than the bond strength between the interlocked first and second closure profiles 36, 38. For example, the bond strength between flange 48 and wall section 40 may be at least about 2.25 pounds per lineal inch. Similarly, the bond strength between flange 54 and wall section 42 may be at least about 2.25 pounds per lineal inch. The bond strength between the interlocked first and second profiles 36, 38 may typically be about 1.5 to 3.5 pounds per lineal inch. This provides for a strong closure, to deter a child from being able to easily disengage the first and second profiles 36, 38, but ensures that the first and second profiles 36, 38 will disengage before either of flanges 48, 54 becomes separated from respective wall constructions 40, 42.

In reference still to FIG. 2, it can be seen that first wall section 40 has a top region 68. Similarly, second wall section 42 has a top region 70. First end 56 is secured to the top region 68, such that a remaining portion of the first closure member 32 extends away and is free from the wall section 40. Analogously, first end 60 of the second closure member 34 is secured along the top region 70, such that a remaining portion of the second closure member 34 extends away and is free from the wall section 42.

Closure mechanism 30 is constructed and arranged to be child-proof. While a variety of working embodiments are contemplated herein, in FIGS. 2 and 3, closure mechanism 30, in general, is configured to be difficult to open to a child because of the lack of flanges on the consumer side of the package, in combination with a strong bond strength between the interlocked first and second profiles 36, 38. Closure mechanism 30 is also constructed and arranged to be openable and recloseable by an adult. In the embodiment shown in FIGS. 2 and 3, closure mechanism 30 includes a pulling arrangement 72.

In general, pulling arrangement 72 is constructed and arranged to permit the application of pulling forces to the engaged first and second profiles 36, 38 in order to disengage or pull apart the interlocked first and second profiles 36, 38. Further, pulling arrangement 72 is configured to be unnoticeable to a child.

In the specific arrangement shown in FIGS. 2 and 3, pulling arrangement 72 is in the form of first and second pull tabs 74, 76. First pull tab 74 has a base portion 78 integral with the flange 48. Opposite of the base portion 78 is a free end 80. As such, the first pull tab 74 is cantilevered from the flange 48 so that the free end 80 is oriented toward the wall section 40. In other words, the free end 80 is between the product supporting bottom 26 (FIG. 1) and the base portion 78.

Second pull tab 76 is constructed and oriented analogously to first pull tab 74. That is, second pull tab 76 includes a base portion 82 and a free end 84. The second pull tab 76 is cantilevered from the flange 54, so that the free end 84 points toward the wall section and the bottom 26 (FIG. 1) of the flexible package 10 (FIG. 1).

FIG. 3 shows the first and second pull tabs 74, 76 in a hidden, or resting position. As shown in FIG. 3, free ends 80, 84 are resting against respective flanges 48, 54. Because of their positions flush against the closure members 32, 34, respectively, a young child may not easily view the first and second pull tabs 74, 76.

First and second pull tabs 74, 76 are movable from their resting position to a pulling or working position. FIG. 2 illustrates first and second pull tabs 74, 76 in their working positions. Note that in the working positions, free ends 80, 84 are spaced from respective flanges 48, 54. The working position shown in FIG. 2 enables a person to position her thumb and forefinger of one hand around one of the first and second pull tabs 74, 76 and to position her thumb and forefinger of the opposite hand around the other of the first and second pull tabs 74, 76. The person may then pull the pull tabs 74, 76 in opposite directions shown at arrows A and B to disengage the first and second profiles 36, 38 respectively. Typically, the pull tabs 74, 76 are pulled in opposite directions with a force sufficient to unlock the first and second profiles 36, 38, respectively, for example at least about 1.5 pounds per lineal inch. After disengaging the first and second profiles 36, 38 to open the zipper mechanism 30, the first and second pull tabs 74, 76 may be released, where they collapse to their resting positions (FIG. 3). The zipper type closure mechanism 30 may then be reclosed by aligning and interlocking the first and second profiles 36, 38.

The closure mechanism 30 may be manufactured using conventional extrusion and heat sealing techniques. In particular, each of the first and second closure members 32, 34 may be extruded through a single die plate fed by an extruder. The extruder carries molten material for forming the profiles 36, 38, the base flanges 48, 54 and the pull tabs 74, 76. As is well known in the art, the die plate includes input ports, output ports, and channels connecting these input ports to output ports. The extruder feeds the molten material to input ports, and the channels are designed to configure the molten material into the shapes of the first and second closure members 32, 34.

The above specification, examples and data provide a complete description of the manufacture and use of the invention. Many embodiments of the invention can be made without departing from the spirit and scope of the invention.

I claim:

1. A flexible package comprising:

(a) a first package wall;

(b) a second package wall secured to said first package wall at a bottom region; said second package wall and said first package wall defining a mouth opposite of said bottom region;

(c) a first closure member constructed and arranged for opening and closing said mouth; said first closure member having opposite first and second ends; said first closure member having a first flange, a first profile extending from said first flange, and a first pull tab extending from said first flange on an opposite side from said first profile;

(i) said first flange being secured to said first package wall; said first flange defining said first end;

(ii) said first profile defining said second end; said first flange extending no further than said second end;

(iii) said first pull tab being cantilevered from said first flange; said first pull tab having a first base portion integral with said first flange and a first free end; said first free end being between said bottom region and said first base portion;

(d) a second closure member constructed and arranged for opening and closing said mouth; said second closure member having opposite third and fourth ends; said second closure member having a second flange, a second profile extending from said second flange, and a second pull tab extending from said second flange on an opposite side from said second profile;

(i) said second flange being secured to said second package wall; said second flange defining said third end;

(ii) said second profile defining said fourth end; said second flange extending no further than said fourth end; said second profile and said first profile being constructed and arranged to selectively interlock;

(iii) said second pull tab being cantilevered from said second flange; said second pull tab having a second base portion integral with said second flange and a second free end; said second free end being between said bottom region and said second base portion; and (A) said first and second pull tabs being constructed and arranged to selectively disengage said first and second profiles and open said mouth.

2. A flexible package according to claim 1 wherein:

(a) said first pull tab being movable between a first resting position and a first working position; said first resting position including the first free end of the first pull tab lying against the first flange; said first working position including the first free end of the first pull tab being spaced from the first flange.

3. A flexible package according to claim 2 wherein:

(a) said second pull tab being movable between a second resting position and a second working position; said second resting position including the second free end of the second pull tab lying against the second flange; said second working position including the second free end of the second pull tab being spaced from the second flange.

4. A flexible package according to claim 3 wherein:

(a) said first and second profiles are constructed and arranged to interlock and form a bond strength of at least 1.5 pounds per lineal inch.

5. A flexible package according to claim 4 wherein:

(a) each of said first and second package walls includes a top edge, a bottom edge, and a pair of side edges extending between the top and bottom edges;

(i) said first and second package walls being secured together along the side edges; and said first and second package walls being secured together along the bottom edges to form said bottom region; and (ii) the top edges of the first and second package walls defining said mouth.

6. A flexible package according to claim 5 wherein:

(a) said first end of said first flange being secured to the top edge of said first package wall; and said second end of said first flange being cantilevered from the top edge of said first package wall.

7. A flexible package according to claim 6 wherein:

(a) said third end of said second flange being secured to the top edge of said second package wall; and said fourth end of said second flange being cantilevered from the top edge of said second package wall.

8. A flexible package according to claim 7 wherein:

(a) said first flange is secured to said first package wall with a bond strength of at least 2.25 pounds per lineal inch; and (b) said second flange is secured to said second package wall with a bond strength of at least 2.25 pounds per lineal inch.

9. A flexible package according to claim 1 wherein:

(a) each of said first and second profiles includes dual tracks.

10. A method of constructing a flexible package; the method comprising the steps of:

(a) providing a first film wall having a top region and a bottom region;

(b) providing a second film wall having a top region and a bottom region;

(c) providing a first closure member having opposite first and second ends, a first flange, a first profile extending from the first flange, and a first pull tab extending from the first flange on an opposite side from the first profile;

(i) said first flange defining said first end;

(ii) said first profile defining said second end; said first flange extending no further than said second end;

(iii) said first pull tab being cantilevered from said first flange; said first pull tab having a first base portion integral with said first flange and a first free end; said first free end being between said bottom regions and said first base portion;

(d) securing the first flange to the first film wall top region at the first closure member first end to orient a first free end of the first flange toward the first film wall; the second end of the first flange extending freely from the first film wall;

(e) providing a second closure member having opposite third and fourth ends, a second flange, a second profile extending from the second flange, and a second pull tab extending from the second flange on an opposite side from the second profile;

(i) said second flange defining said third end;

(ii) said second profile defining said fourth end; said second flange extending no further than said fourth end; said second profile and said first profile being constructed and arranged to selectively interlock;

(iii) said second pull tab being cantilevered from said second flange; said second pull tab having a second base portion integral with said second flange and a second free end; said second free end being between said bottom regions and said second base portion; and (f) securing the second flange to the second film wall top region at the second closure member third end to orient a second free end of the second flange toward the second film wall; the fourth end of the second flange extending freely from the second film wall; the second profile being oriented to oppose the first profile to allow for selective engagement.

11. A method of constructing a flexible package according to claim 10 including a step of:

(a) heat sealing side edges of the first and second film walls.

12. A method of constructing a flexible package according to claim 11 including a step of:

(a) heat sealing bottom edges of the first and second film walls.

13. A method of constructing a flexible package according to claim 10 wherein:

(a) said step of securing the first flange to the first film wall top region includes heat sealing the first flange to the first film wall top region to form a bond strength of at least 2.25 pounds per lineal inch; and (b) said step of securing the second flange to the second film wall top region includes heat sealing the second flange to the second film wall top region to form a bond strength of at least 2.25 pounds per lineal inch.

14. A method of constructing a flexible package according to claim 10 wherein:

(a) said step of providing a first closure member includes providing a first closure member having a first pull tab, wherein the first pull tab is movable between a first resting position and a first working position; the first resting position including the first free end of the first pull tab lying against the first flange; the first working position including the first free end of the first pull tab being spaced from the first flange.

15. A method of constructing a flexible package according to claim 14 wherein:

(a) said step of providing a second closure member includes providing a second closure member having a second pull tab, wherein the second pull tab is movable between a second resting position and a second working position; the second resting position including the second free end of the second pull tab lying against the second flange; the second working position including the second free end of the second pull tab being spaced from the second flange.

* * * * *